US006505449B1

(12) United States Patent
Gregori

(10) Patent No.: US 6,505,449 B1
(45) Date of Patent: Jan. 14, 2003

(54) STRUCTURAL ELEMENT

(75) Inventor: Karl H. W. Gregori, Orillia (CA)

(73) Assignee: Composit Wood Specialties Ltd., Ontario (CA)

( * ) Notice: Subject to any disclaimer, the term of this patent is extended or adjusted under 35 U.S.C. 154(b) by 0 days.

(21) Appl. No.: 09/626,618

(22) Filed: Jul. 27, 2000

(51) Int. Cl.[7] ..... E04G 23/02; E04F 15/00

(52) U.S. Cl. ..... 52/514; 52/300; 52/483.1; 52/800.12; 52/800.18

(58) Field of Search ..... 52/300, 514, 800.11, 52/800.12, 800.18, 716.2, 716.8, 717.05, 717.06, 730.1, 731.2, 732.1, 731.1, 730.7, 483.1, 729.4, 729.2; 144/332

(56) References Cited

U.S. PATENT DOCUMENTS

| | | | | | |
|---|---|---|---|---|---|
| 2,178,388 | A | * | 10/1939 | Beckman | 52/514 |
| 3,363,390 | A | * | 1/1968 | Crane et al. | 52/716.8 |
| 3,416,282 | A | * | 12/1968 | Daugherty | 52/716.8 |
| 3,451,169 | A | * | 6/1969 | Arnold et al. | 52/716.8 X |
| 3,531,901 | A | * | 10/1970 | Will | 52/729.4 X |
| 3,662,509 | A | * | 5/1972 | Studzinki | 52/404 |
| 4,105,814 | A | * | 8/1978 | Eggert | 52/716.8 X |
| 4,329,827 | A | * | 5/1982 | Thorn | 52/730.7 X |
| 4,443,508 | A | * | 4/1984 | Mehl | 52/716.8 X |
| 4,466,225 | A | * | 8/1984 | Hovind | 52/730 |
| 4,668,556 | A | * | 5/1987 | Mermann et al. | 428/122 |
| 4,676,469 | A | * | 6/1987 | Rotermund et al. | 52/729.2 |
| 4,715,162 | A | * | 12/1987 | Brightwell | 52/729.4 |
| 4,742,654 | A | * | 5/1988 | Cole | 52/97 |
| 4,848,049 | A | * | 7/1989 | Hanson | 52/97 |
| 4,858,399 | A | * | 8/1989 | Salato | 52/97 |
| 4,967,534 | A | * | 11/1990 | Lines | 52/729.4 |
| 5,148,644 | A | * | 9/1992 | Weir | 52/300 |
| 5,163,254 | A | * | 11/1992 | Zastro et al. | 52/27 |
| 5,245,803 | A | * | 9/1993 | Hagg | 52/300 |
| 5,274,974 | A | * | 1/1994 | Haag | 52/300 |
| 5,274,975 | A | * | 1/1994 | Haag | 52/300 |
| 5,280,692 | A | * | 1/1994 | Paety | 52/731.1 X |
| 5,323,584 | A | * | 6/1994 | Scarlett | 52/730.7 |
| 5,475,959 | A | * | 12/1995 | Mackenzie | 52/403.1 |
| 5,476,704 | A | * | 12/1995 | Kohler | 52/729.2 X |
| D382,653 | S | * | 8/1997 | Colitto | D25/122 |
| 5,772,185 | A | * | 6/1998 | Pulsipher | 256/59 |
| 5,875,605 | A | * | 3/1999 | Rudd | 52/730.7 X |
| 6,012,262 | A | * | 1/2000 | Irving | 52/729.4 |
| 6,148,579 | A | * | 11/2000 | Rolf | 52/639 |
| 6,209,282 | B1 | * | 4/2001 | Lafrance | 52/729.4 X |
| 6,223,497 | B1 | * | 5/2001 | Ohtake et al. | 52/716.8 X |

* cited by examiner

*Primary Examiner*—Robert Canfield
(74) *Attorney, Agent, or Firm*—Baker Botts LLP

(57) ABSTRACT

A structural element for use with a structural member has a longitudinally extending body. The body has a lower surface and opposed side flanges hanging down below the lower surface. The element may have one more extending hollow channels above the lower surface to assist in preventing moisture from passing beneath the structural element. The structural element is adapted to be positioned on top of an area of a structural member, such as a joist or beam. The structural element can be made from a composite wood material.

39 Claims, 8 Drawing Sheets

STRUCTURAL ELEMENT

FIELD OF THE INVENTION

This invention relates to structural elements that can be used to repair and/or protect a structural member such as a damaged joist or beam and/or be used to protect such members.

BACKGROUND OF THE INVENTION

Although various advanced materials have been produced, a large amount of residential and commercial construction, both interior and exterior, still utilizes wooden joists and beams. Unfortunately, one of the problems structural members such as wooden joists and beams in an exterior environment, is that they are susceptible to damage from decay and rot, particularly such damage caused by or linked with moisture.

Although there are preservative treatments available for wood, the extra cost for such treated wood is high. Furthermore, the treatment itself will have a limited lifetime, and eventually even a structural member made from treated wood will start to rot or decay. Furthermore, most of the wooden joists and beams currently installed in buildings today have wooden members that are untreated.

For structural members such as joists and beams, an area that is particularly susceptible to rot and decay caused by moisture is the top of the joist or beam. It is there where moisture tends to become trapped between the top of the joist or beam and the structure or components that are being supported by the structural member (for example, a deck). Moisture is unable to easily drain away from between the top of the joist or beam and the bottom of the supported structure. However, often only a limited top portion of a beam or joist is in a damaged condition. Nevertheless, when replacing a deck or other supported feature, one will usually have to replace an entire beam or joist, which may only be damaged on the upper portion.

Another cause of damage to the top of joists or beams that support a deck, occurs when the top decking must be replaced. In removing the decking material, it is quite common for the process to cause damage to the underlying beams and joists as the deck material is pried or disengaged from its supporting beams and joists. The result is joist/beam repair or replacement is commonly needed before a new deck material is placed down on the joists and beams.

Accordingly, it is desirable to have an efficient means of repairing and protecting a structural member such as a joist or beam. Also, it is desirable to provide an efficient way of reducing the risk of wooden structural members being damaged, either by water or other ways in the first place, by protecting these members from the time they are first installed.

SUMMARY OF THE INVENTION

According to one aspect of the invention, there is provided a structural element for use with a structural member, said element comprising: a longitudinally extending body with an upper surface and a lower surface, and with a pair of opposed, spaced apart, downwardly depending flanges extending below said lower surface; said upper surface of said longitudinally extending body being generally flat, and said lower surface and said flanges being configured to be positioned above an area of a structural member; said side flanges being adapted to be secured to sides of said structural member.

According to another aspect of the invention, there is provided a structural combination of a structural member and a structural element, said structural element comprising: a longitudinally extending body having an upper surface and a lower surface, and having opposed, spaced apart, downwardly depending side flanges extending below said lower surface; said structural element configured such that said lower surface is positioned above a first surface area of a structural member, said structural member having a pair of opposed side surfaces proximate said first surface area and each said side surface being oriented downward from said first surface area; said side flanges of said structural element being configured to be and being secured with one or more attachment members to the side surfaces of said structural member.

According to another aspect of the invention, there is provided a method of repairing a damaged member with a repair element, said damaged member having an upper surface that is at least partially damaged, and two opposed sides, said repair element comprising: a longitudinally extending body having an upper surface and a lower surface, and having a pair of opposed, spaced apart, downward depending flanges extending below said lower surface; said upper surface of said longitudinally extending body being generally flat, and said lower surface being adapted to be positioned above said damaged member; said side flanges being adapted to be secured to the sides of said damaged member; said method comprising the steps of: (a) placing said repair element in a position where said lower surface of said repair element is over the upper surface of said damaged member, with a flange of said repair element being positioned adjacent to each side surface of said damaged member; (b) securing said flanges of said repair element to the sides of said damaged member.

According to another aspect of the invention, there is provided a method of protecting a structural member with a structural element, said structural member having an upper surface and two opposed side surfaces, said structural element comprising: a longitudinally extending body having an upper surface and a lower surface, and having a pair of opposed, spaced apart, downward depending flanges extending below said lower surface; said lower surface being configured to be positioned to above a surface of said structural member; said side flanges being adapted to be secured to a side surface of said structural member; said method comprising the steps of: (a) placing said structural element in a position where said lower surface of said structural element is in an opposed relation to said surface of said structural member and with each flange of said structural element being adjacent to a side surface of said structural member, such that said lower surface is above said surface of said structural member; (b) securing said flanges to the side surfaces of said structural member to secure said structural element to said structural member.

BRIEF DESCRIPTION OF THE DRAWINGS

In figures which illustrate, by way of example only, embodiments of the present invention.

DETAILED DESCRIPTION OF THE PREFERRED EMBODIMENTS

Figure 1:
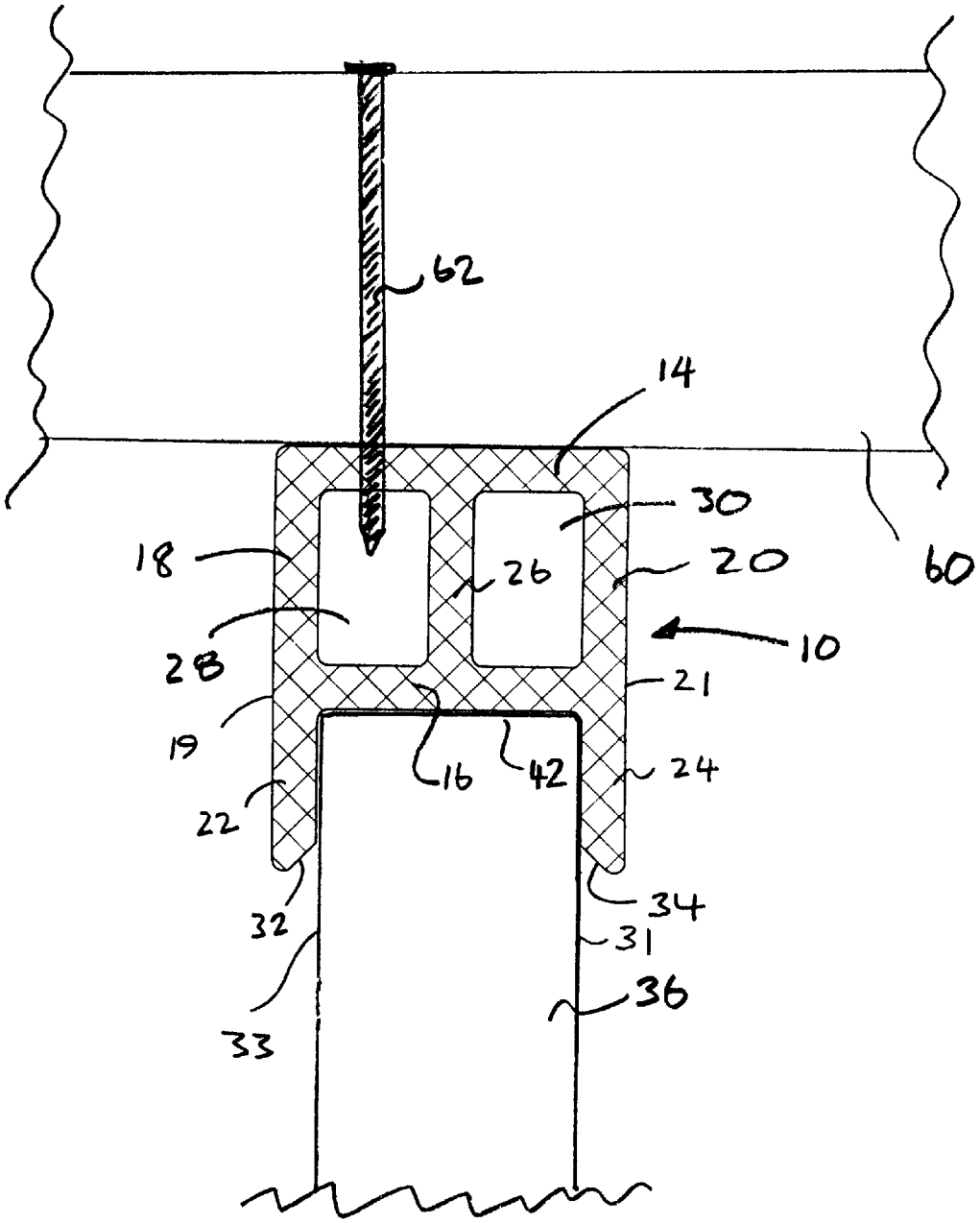
FIG. 1 is a cross-sectional, elevation view of a structural element.
Figure 2:
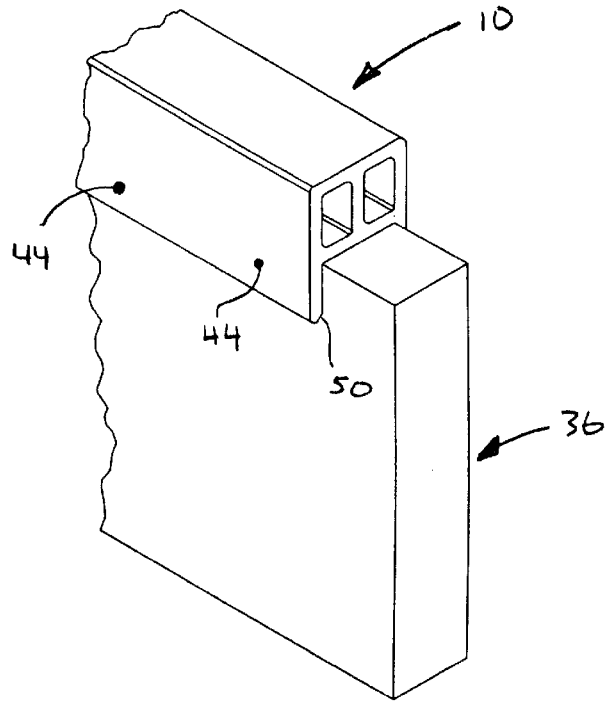
FIG. 2 is a perspective view of the structural element of FIG. 1 shown in use with a joist that has been repaired.
Figure 3:
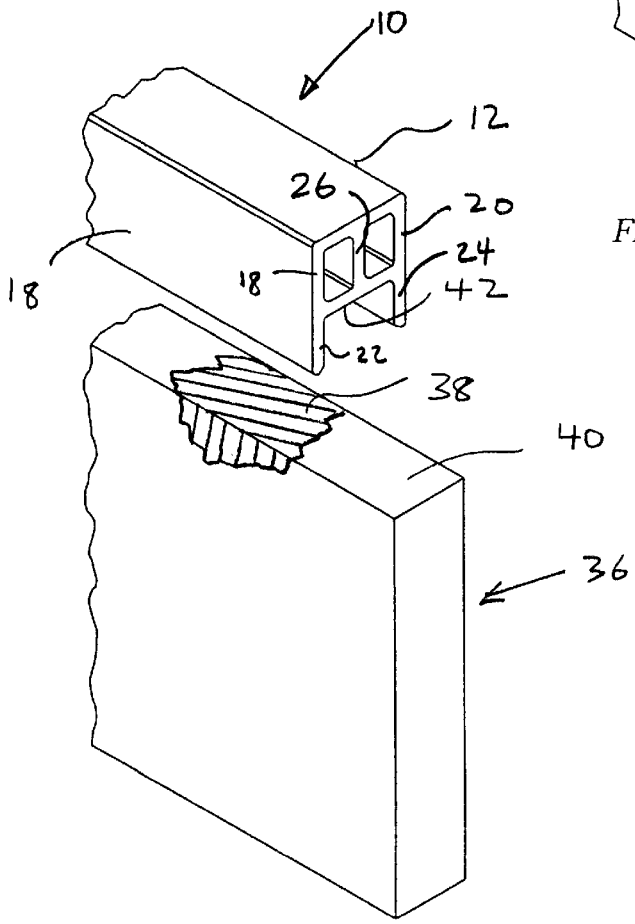
FIG. 3 is a perspective view with a repair element shown exploded away from a joist to be repaired.

With reference to FIGS. 1, 2 and 3, a structural element generally designated 10 is illustrated. Element 10 has a longitudinally extending body 12 with a longitudinally extending top portion 14 and a longitudinally extending base portion 16. The body also has a pair of opposed longitudinally extending side walls 18 and 20. Each side wall 18 and 20 has a longitudinally extending lower flange portion (22, 24 respectively) extending down from, and below, base portion 16.

Extending between the upper portions of side walls 18 and 20 is a central longitudinally extending wall portion 26 which stretches from the top portion 14 to base portion 16 thereby creating two longitudinally extending hollow channels 28 and 30.

Channels 28 and 30 are continuous and provide for sealed channels that are open only at their ends. Any moisture that does permeate into the channels 28 and 30, will be able to see out of the element 10 at its ends, and in that regard, a small gap could be provided at the end between the end of the element and any abutting member.

Figure 1A:
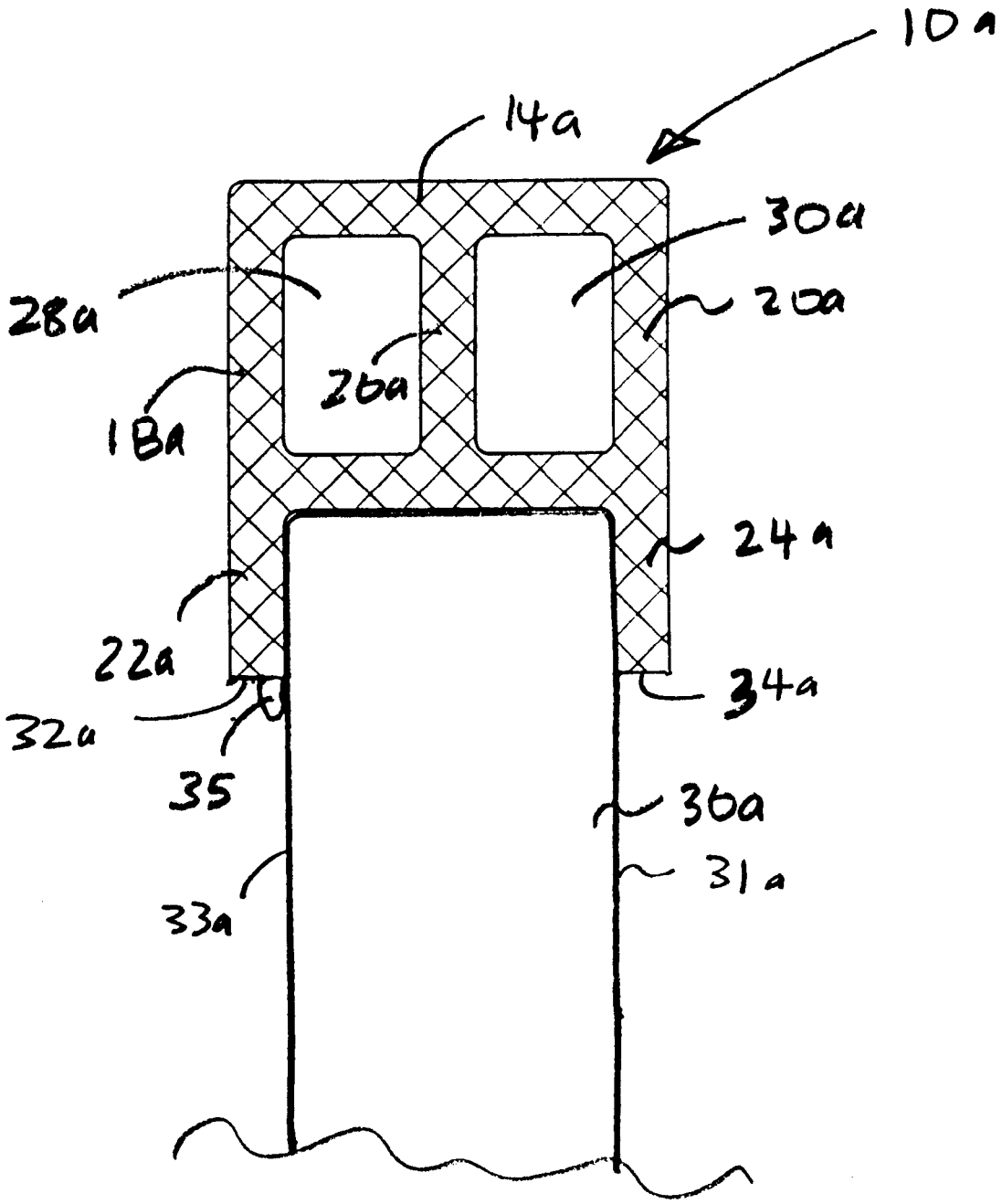
FIG. 1*a* is a cross-sectional, elevation view of the bottom part of an alternate configuration for lower edges of the flanges of a structural element.

In FIG. 1*a,* a profile of an element 10*a,* of the bottom of flanges 22*a* and 22*b* is shown wherein lower edges 32*a* and 34*a* are perpendicular to the outer faces 31*a* and 33*a* of the joist 36. In this embodiment however, there will be a tendency for water droplets 35 to accumulate as shown. A more preferred embodiment of the invention is shown in detail in FIG. 1, where the bottom edges 32 and 34 of flange portions 22 and 24 respectively are angled downwardly from adjacent outer faces 31 and 33 of joist 36 to the outer faces 19 and 21 of side walls 18 and 20. Thus, in the embodiment of FIGS. 1, 2 and 3, any moisture which drains down the outside faces of side walls 18 and 20, will tend not to become trapped, as there is not the same right angled intersection of edges 32*a* and 34*a* and the outside faces 31*a* and 33*a* of the joist 36*a* in element 10*a*.

Figure 5:
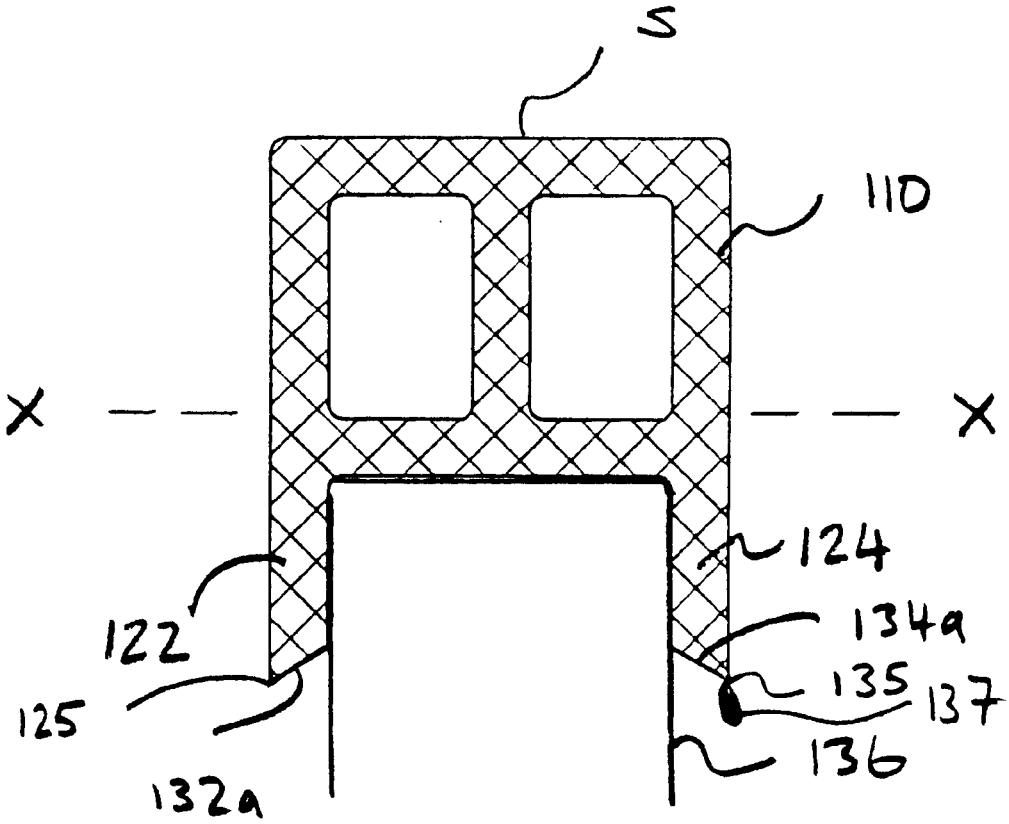
FIG. 5 is a cross sectional, elevation view of a first, alternate embodiment of a structural element.
Figure 6:
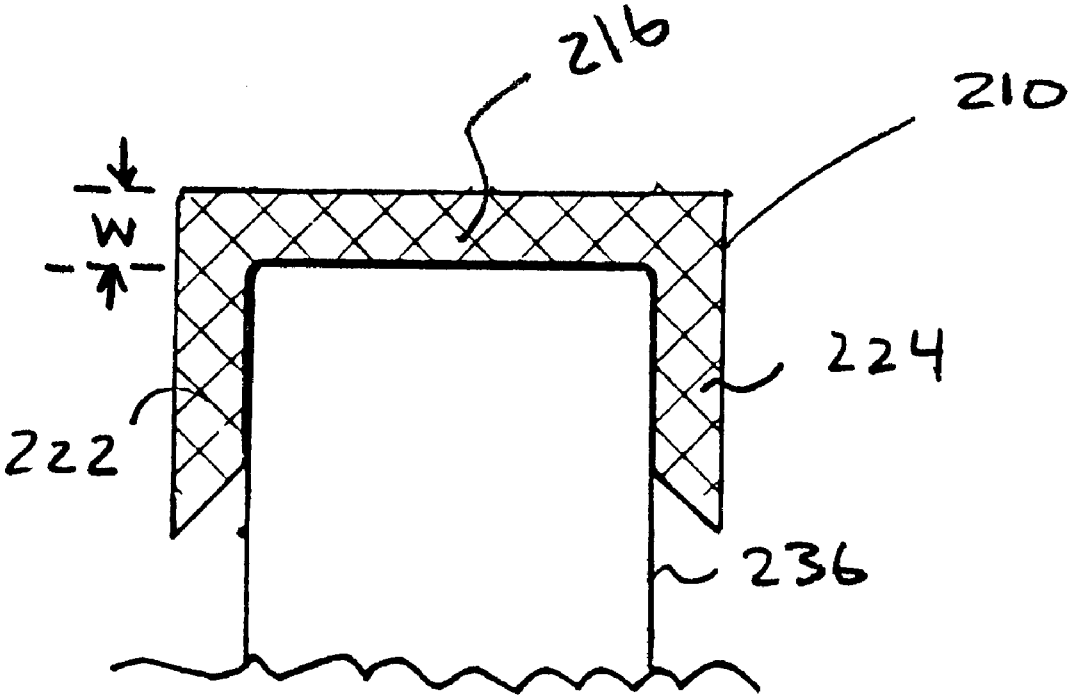
FIG. 6 is a cross sectional, elevational view of a second alternate embodiment of a structural element.

With reference to FIGS. 5 and 6, joists 136 and 236 are shown with structural elements 110 and 210, respectively. Structural element 110 has flanges 122 and 124 with lower edge faces 132*a* and 134*a,* respectively. Lower edge faces 132*a* and 134*a* has longitudinally extending relatively sharp tips 125 and 135, respectively. Providing a relatively sharp tip will tend to reduce the chance of water droplets 137 curling under and accumulating along edge 132*a* and 134*a* to contact a side face of joist 136. Rather, with a relatively sharp tip, water droplets will tend to drop straight down, and if touching the side of joist 136 at all, will only contact sides faces of joist 136 lower down. Structural element 210 as shown in FIG. 6, is configured with relatively sharp tips on the lower edges of the flanges 222 and 224.

Element 10 can be used when a joist or beam is first being installed in the structure or installed during repair, refitting or maintenance of a joist or beam.

Element 10 could possibly be made from any one or more of metals, plastics, fibers including wood, elastomers, ceramics, glass, concrete, or composites or any of the foregoing, so long as they are strong enough to withstand the load applied from above (eg. such as the weight of the deck being supported thereon). If element 10 is made of a material such as wood, it will itself be subject to a high risk of rot or decay. Also, the example configuration of the elements, particularly with a configuration such as element 10 and 110 shown in FIGS. 1, would be difficult to make from wood. Nevertheless, using an element 10 made of wood still provides advantages. For example, if repair is necessary to a combination of a joist/beam and an element 10, then repair of the overall joist or beam will likely not be necessary; the only repair that is likely to be needed is the element 10.

However, enhanced benefits are obtained if element 10 is not made of wood of a material which in addition to being strong enough to support the required load, is also a material which is not particularly susceptible to breakdown or damage, such as damage due to water. Also, in most residential and commercial construction, it is more preferable if element 10 is made from a material which is relatively easily and efficiently formed into a desired configuration, is relatively inexpensive, and is not too heavy. Composite materials are therefore quite suitable and these materials can be extruded to the desired configuration for an element 10. One of the most advantageous composites for element 10 is to make it from a composite wood material. Such a product can be made by combining wood fragments such as wood flakes, strands, particles, chips and fibers with a resin, particularly a thermoplastic resin, and then extruding the mixture through an extruding mould, and allowing the extruded product to fully set. Examples of suitable resins include polyethylene and polypropylene. Some examples of a composite wood material are disclosed in U.S. Pat. No. 3,888,810 to Shinomura, the contents of which are hereby incorporated by reference. The composite wood element 10 could be extruded using a technique similar to that described in U.S. Pat. No. 5,234,652 to Woodhams and U.S. Pat. No. 5,783,125 to Bastone et al., the contents of which are hereby incorporated by reference.

In FIG. 3, a typical wooden joist 36, such as a two by ten joist, is shown. Along part of the top surface 40, and extending down part way into the joist 36, is a rot or decay area 38. While not necessary, when repairing such a joist 36, prior to mounting element 10 on the top of joist 36, decayed area 38 is preferably removed from the joist, for example by cutting it out with a saw or similar tool.

As illustrated in FIG. 2, the lower face 42 of base 16 of element 10 when in place, is positioned on top of top surface 40 of joist 36 shown in FIG. 2. Once element 10 is positioned on top of joist 36, the element can be secured by attachment means or members such as bolts, staples, screws, spikes, or nails 62 driven or passing through the lower flange portions 22 and 24 of side walls 18 and 20, respectively or other suitable attachment means, to attach the flanges to the sides of the joist 36.

The channel 50 between the edges 32 and 34 of the outer flange portions 22 and 24 and the outside side face of the joist 36 is maintained, even once the flanges are secured in place, as this allows water to drain away from the contact area between the inner face of the flanges and the side face of the joist.

It will be appreciated that when in place, as shown in FIG. 2, element 10 provides a barrier between the top of the joist and the structure that is being supported; element 10 tends to insulate the top of the joist 36 from the structure or members that it is supporting.

Figure 4:
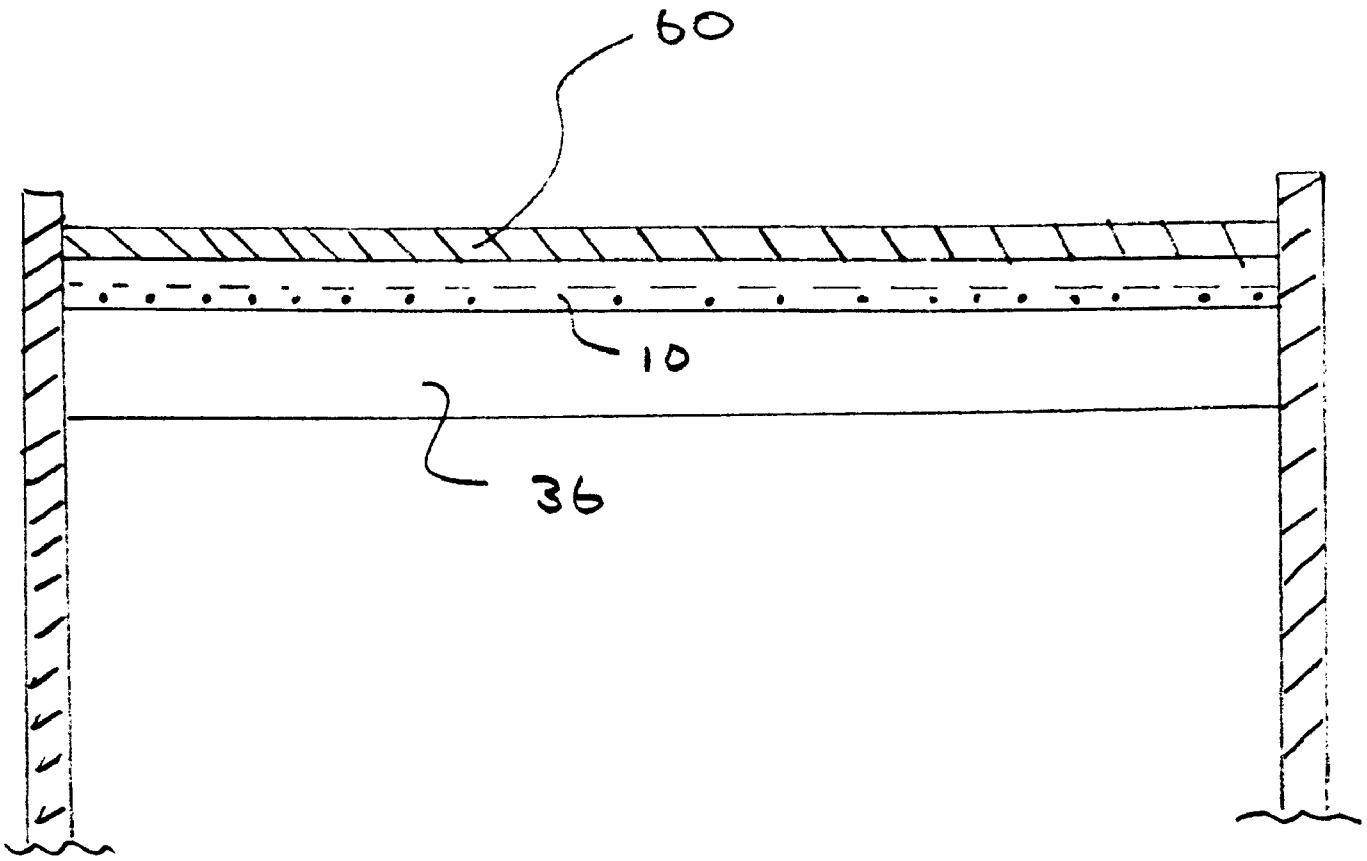
FIG. 4 is a side elevation view showing a structural element in use in a structure.

Turning to FIG. 4, an example of use of a structural element 10 in a deck structure is shown. Decking 60 is shown supported by a plurality of joists 36 each having an element 10 secured on top of the joist 36 (only one joist and element 10 clan be seen in the side view). Decking may be any known decking material including a composite wood decking such as is disclosed in U.S. Pat. No. design 423,116 issued Apr. 18, 2000. Nails 62 or other attachment members can be secured through the decking 60 into the top 14 of element 10. Thus, if there is any prospect of any moisture leakage from the deck surface, it is more likely to find its way into longitudinally extending channels 28 and 30. In any event, moisture will be unlikely to reach the top portion of joist 36. Thus, the top portion of joist 36 is essentially insulated from moisture at, or passing from, the lower surface of deck 60.

With reference to FIG. 4, it can be seen that element 10 can stretch the entire length of the joist 36. The joist 36 shown, is one of several such joist in horizontal alignment and being supported between two walls 44 and 46. Other arrangements are of course possible, as known in the art, for supporting decking. For example, the joists may be interconnected by supporting beams which themselves are supported on posts.

To maintain a level deck surface with respect to several adjacent joists 36, either elements 10 will have to be added to each of the joists or the joist being repaired will have to have its top portion removed along its length so that the top surface of element 10 coincides with the top of the joist being repaired and adjacent joists. To provide for future protection of all joists, it is usually preferred to provide all joists in a structure with elements 10.

Element 10 could be employed over just part of a joist or beam; but this would likely require a portion of the member be removed, to ensure a continuous flat upper surface along the entire length of the structural member.

As mentioned above, it is possible to utilize elements 10 when a set of joists or beams or both are initially being installed, by providing for elements to insulate the tops of the joists or beams from the above supported structure. Thus element 10 will serve to protect the joists and beams and reduce the risk of damage occurring, such as from moisture. Also, when replacing a deck supported by the joists/beams, having element 10 installed will protect the joist or beam when the old deck is being removed, and only one or more elements 10 will have to be replaced.

With reference again to FIGS. 5 and 6, it will be appreciated that the addition of an element 110 onto a joist or beam 136 will raise the overall height of the top surface. By way of example, the addition of element 110 on top of a joist might raise the top surfaces by about 1½ inches. In some circumstances, however, there may be constraints which do not permit this additional height. Accordingly, the element 110 could be cut along line x—x shown in FIG. 5 along its length to produce in element 210 as shown in FIG. 6. Alternatively, element 210 may be extruded in this specific configuration. For element 210 the only additional height above the top of the joist or beam 236 is the thickness of the material "w" which might for example be ¼ inch. This reduced thickness can perhaps be more easily be accommodated. Element 210 can be used in conjunction with a composite wood decking 300, such as the decking disclosed in U.S. Pat. No. design 423,116 issued Apr. 18, 2000 to Gregori, the contents of which are incorporated by reference. Composite wood decking is often not as deep as standard wood decking and so using it in combination with an element 210 may result in no overall increase in height of the top surface of the deck.

Element 210 does not provide all the benefits of elements 10 and 110, in that it does not have elements such as channels 28 and 30. Therefore, when decking is attached to the element 210 through top portion 216, it is possible that the nails or other attachment members may pass into joist or beam 236. Thus, a little moisture may be able to pass to the top of the joist or beam 236. Nevertheless, element 210 can still provide a significant degree of protection for the joist or beam 236.

Figure 7:
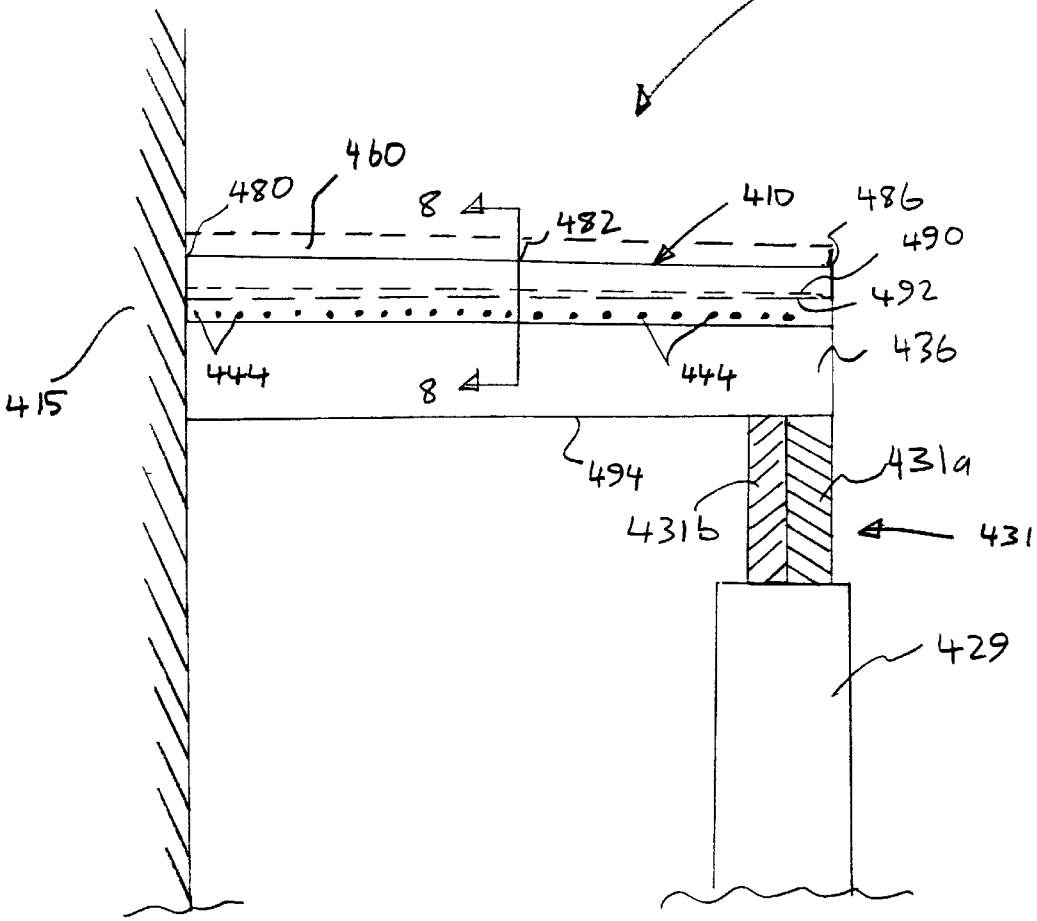
FIG. 7 is a side elevational view of an alternate arrangement of a structural element in a structure.
Figure 8:
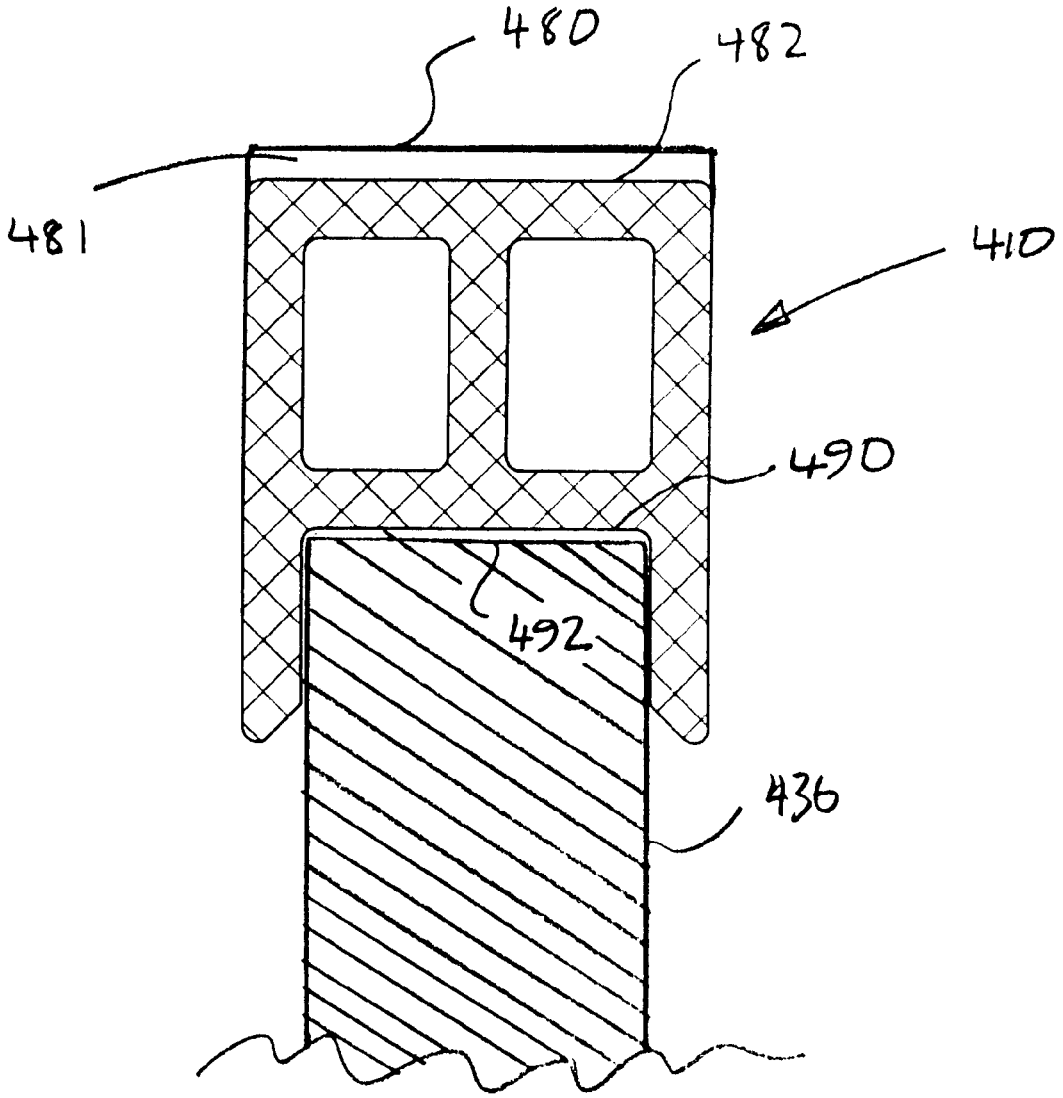
FIG. 8 is a cross sectional view at 8—8 in FIG. 7.

With reference to FIGS. 7 and 8, a structural element 410 similar to element 10 is shown in use in a deck structure 411 adjoining a wall 415 of a building. Structure 411 comprises decking 460 supported on a series of spaced apart joists 436 each having a structural element 410 positioned proximate its upper surface 492. Joists 436 are supported at one end by conventional attachment (not shown) to wall 415 and supported at the opposite end by a beam 431 comprising two beam components 431*a*, 431*b*, such as for example two, 2×8 lengths of wood, nailed together. The beam 431 is supported by a plurality of posts such as post 429.

The structural element 410 has a bottom surface 490 which is positioned in opposite but spaced relation to top surface 492 of joist 436. In this embodiment top surface 492 is horizontally oriented, whereas bottom surface 490 of structural element 410 is sloped downward from left to right in FIG. 7. This orientation is also illustrated in the elevation view in FIG. 8 where rear edge 480 of the top surface 481 of element is positioned above median edge 482 (the decking 460 is not shown in FIG. 8). Thus, top surface 481 of element slopes downward from rear edge 480 to front edge 486. In yet another alternate embodiment (not shown), the bottom surface 490 of each element 410 could rest on top surface 492 of each joist 436 at their front edges.

The bottom surface 490 of element 410 is maintained in spaced relation to top surface 492 of joist 436 by attachment devices such as for example nails 444. The spacing of nails 444 will be selected to ensure that it can properly support the loads on the structural element including the load from decking 460.

By being able to vary the orientation of elements 410 relative to their respective joists 436, the elements 410 are able to vary the orientation of the upper surface supporting the decking 460. Thus, as shown in FIGS. 410, elements 410 can be oriented to ensure that water on decking 460 will drain away from wall 415. It will, however, be appreciated that within limits resulting from the size and configuration, the orientation of elements 410 relative to their respective joists 436 can be varied within a range, to provide a desired orientation for the upper surface.

The above described embodiments are intended to be illustrative only and in no way limiting. The described embodiments of carrying out the invention are susceptible to modification of form, size, arrangement of parts, composition and details of operation. Rather, it is intended to encompass all such modifications within its scope as defined by the claims. For example, the structural elements of the present invention could be used in conjunction with other structural members, in addition to beams and joists, including but not limited to roof rafters and posts. Also, the side flanges do not have to be continuous along the entire length of the structural element.

Although many of the applications for such structural elements are for exterior construction environments, these structural elements are also applicable to interior environments. For example, although there may be little risk of damage to beams and joist from moisture inside a particular building, the use of such structural elements can still be beneficial. For example, in interior applications, such structural elements can, as in outdoor applications, provide a leveling or orienting function, as described above.

I claim:

1. A structural combination of a structural joist member and a structural element mounted on said structural member, said combination for use in supporting a structure, said structural joist member being made of solid wood, said structural joist member being capable of carrying the load of said structure without said structural element, said structural element being made of a composite wood and said structural element comprising:

a longitudinally extending body having an upper surface and a lower surface, and having opposed, spaced apart, downwardly depending side flanges extending below said lower surface, said body also having at least one longitudinally extending channel therein located between said upper surface and said lower surface;

said structural element configured such that said lower surface is positioned above a first surface area of a structural member, said structural member having a pair of opposed side surfaces proximate said first surface area and each said side surface being oriented downward from said first surface area;

said side flanges of said structural element being configured to be and being secured with one or more attachment members to the side surfaces of said structural member.

2. A combination as claimed in claim 1 further comprising a supported structure positioned above and supported by said structural member and said structural element.

3. A combination as claimed in claim 1 wherein said supported structure is secured to said structural element at said upper surface with attachment means and said at least some of said attachment means penetrating through said upper surface into said hollow channel of said structural element but not penetrating through said lower surface of said structural element.

4. A combination as claimed in claim 3, wherein said supported structure is decking.

5. A combination as claimed in claim 1 wherein said supported structure is secured to said structural element at said upper surface with one or more attachment members, at least some of said attachment members penetrating through said upper surface of said structural element but not penetrating through said lower surface of said structural element.

6. A combination as claimed in claim 5, wherein said supported structure is decking.

7. A combination as claimed in claim 1 wherein said side surfaces of said structural member are oriented at substantially ninety degrees to said top surface.

8. A combination as claimed in claim 1, wherein said lower surface of said structural member is positioned in a spaced relation with said first surface area of said structural member.

9. A combination as claimed in claim 1 wherein said lower surface of said structural member is positioned at least in part in a spaced relation from said first surface area of said structural member.

10. A combination as claimed in claim 9 wherein said upper surface of said structural element is oriented at a different angle to the first surface area of said structural member.

11. A combination as claimed in claim 1 wherein said upper surface of said longitudinally extending body is generally flat.

12. A combination as claimed in claim 11, wherein said lower surface of said body is configured to be and is positioned in a seated arrangement on said first surface area.

13. A combination as claimed in claim 1 wherein at least part of said lower surface is of said structural element is in contact with said first surface area of said structural member.

14. A combination as claimed in claim 1 wherein said lower surface of said structural element is in contact with said first surface area, along substantially all of the length of said lower surface.

15. A method of repairing a damaged member made substantially from wood, with a repair element made from a composite wood, said damaged member having an upper surface that is at least partially damaged, and two opposed sides, said repair element comprising:

a longitudinally extending body having an upper surface and a lower surface, and having a pair of opposed, spaced apart, downward depending flanges extending below said lower surface;

said upper surface of said longitudinally extending body being generally flat, and said lower surface being adapted to be positioned above said damaged member;

said side flanges being adapted to be secured to the sides of said damaged member;

said method comprising the steps of:

(a) placing said repair element in a position where said lower surface of said repair element is over the upper surface of said damaged member, with a flange of said repair element being positioned adjacent to each side surface of said damaged member;

(b) securing said flanges of said repair element to the sides of said damaged member.

16. A method as claimed in claim 15 wherein said lower surface of said repair member is positioned in a seated relationship with said damaged member.

17. A method as claimed in claim 15 wherein at least part of said lower surface of said repair element is placed in contact with said upper surface of said damaged member.

18. A method of protecting a structural member made substantially from wood with a structural element made from a composite wood, said structural member having an upper surface and two opposed side surfaces, said structural element comprising:

a longitudinally extending body having an upper surface and a lower surface, and having a pair of opposed, spaced apart, downward depending flanges extending below said lower surface;

said lower surface being configured to be positioned to above a surface of said structural member;

said side flanges being adapted to be secured to a side surface of said structural member:

said method comprising the steps of:

(a) placing said structural element in a position where said lower surface of said structural element is in an opposed relation to said surface of said structural member and with each flange of said structural element being adjacent to a side surface of said structural member, such that said lower surface is above said surface of said structural member;

(b) securing said flanges to the side surfaces of said structural member to secure said structural element to said structural member.

19. A method as claimed in claim 18 wherein said lower surface of said repair element is positioned in a seated relationship with said area of said structural member.

20. A method as claimed in claim 18 wherein said lower surface of said structural element is positioned in contact with said area of said structural member.

21. A structural combination of a structural member, a structural element mounted on said structural member and a supported structure mounted on said structural element, said structural element comprising:

a longitudinally extending body having a hollow longitudinally extending hollow channel defined between an upper wall portion having an upper surface and a lower wall portion having a lower surface, and said body having opposed, spaced apart, downwardly depending side flanges extending below said lower surface;

said structural element configured such that said lower surface is positioned above a first surface area of said structural member, said structural member having a pair of opposed side surfaces proximate said first surface area and each said side surface being oriented downward from said first surface area;

said side flanges of said structural element being configured to be and being secured with one or more attachment members to the side surfaces of said structural member; said supported structure being secured to said structural element by one or more attachment members, said attachment members penetrating through a portion of said supported structure and said upper portion of said structural element but not penetrating through said lower portion of said structural element.

22. A combination as claimed in claim 21 wherein said structural member is a joist.

23. A combination as claimed in claim 22 wherein said body has at least one longitudinally extending channel between said upper surface and said lower surface, and wherein at least one of said at least one attachment members protrudes into said channel.

24. A combination as claimed in claim 22 wherein said structural member is made of wood, and said structural element is made of a material of one or more of a suitable metal, plastic, elastomer, ceramic, glass or a composite.

25. A combination as claimed in claim 24 wherein said structural element is made of a composite wood material.

26. A combination as claimed in claim 22 wherein said side surfaces of said structural member are oriented at substantially ninety degrees to said top surface.

27. A combination as claimed in claim 22, wherein said supported structure is decking.

28. A combination as claimed in claim 25, wherein said supported structure is decking.

29. A combination as claimed in claim 22, wherein said lower surface of said structural member is positioned in a spaced relation with said first surface area of said structural member.

30. A combination as claimed in claim 22 wherein said lower surface of said structural member is positioned at least in part in a spaced relation from said first surface area of said structural member.

31. A combination as claimed in claim 22 wherein said upper surface of said structural element is oriented at a different angle to the first surface area of said structural member.

32. A combination as claimed in claim 22 wherein said upper surface of said longitudinally extending body is generally flat.

33. A combination as claimed in claim 22 wherein at least part of said lower surface is of said structural element is in contact with said first surface area of said structural member.

34. A combination as claimed in claim 22 wherein said lower surface of said structural element is in contact with said first surface area, along substantially all of the length of said lower surface.

35. A structural combination of a structural member and a structural element, said structural element comprising:

a longitudinally extending body having an upper surface and a lower surface, and having opposed, spaced apart, downwardly depending side flanges extending below said lower surface;

said structural element configured such that said lower surface is positioned above a first surface area of a structural member, said structural member having a pair of opposed side surfaces proximate said first surface area and each said side surface being oriented downward from said first surface area;

said side flanges of said structural element being configured to be and being secured with one or more attachment members to the side surfaces of said structural member; and wherein said upper surface of said structural element is oriented at a different angle to the first surface of said structural member.

36. A combination as claimed in claim 35 wherein said lower surface of said structural member is positioned at least in part, in spaced relation from said first surface area of said structural member.

37. A combination as claimed in claim 35 wherein a supported structure is supported on said upper surface of said structural element.

38. A combination as claimed in claim 37 wherein said supported structure is a deck.

39. A combination as claimed in claim 35 wherein said structural member is a joist.

* * * * *

UNITED STATES PATENT AND TRADEMARK OFFICE

CERTIFICATE OF CORRECTION

PATENT NO. : 6,505,449 B1
DATED : January 14, 2003
INVENTOR(S) : Gregori, Karl H. W.

It is certified that error appears in the above-identified patent and that said Letters Patent is hereby corrected as shown below:

Title page,
Item [73], Assignee, "Composit Wood Specialties Ltd.," should read -- Composit Building Products International Inc., --

Signed and Sealed this

Twenty-sixth Day of August, 2003

JAMES E. ROGAN
*Director of the United States Patent and Trademark Office*